US005720580A

United States Patent [19]

Ryhsen

[11] Patent Number: 5,720,580

[45] Date of Patent: Feb. 24, 1998

[54] APPARATUS FOR AND METHOD OF SHORING A TRENCH

[75] Inventor: Dieter Ryhsen, Wassenberg, Germany

[73] Assignee: KVH Verbautechnik GmbH, Heinsberg

[21] Appl. No.: 577,806

[22] Filed: Dec. 22, 1995

[51] Int. Cl.[6] ..... E02D 17/00

[52] U.S. Cl. ..... 405/282; 405/283

[58] Field of Search ..... 405/272, 273, 405/282, 283

[56] References Cited

U.S. PATENT DOCUMENTS 3,910,054 10/1975 Krings ..... 405/282

5,503,504 4/1996 Hess et al. ..... 405/272

FOREIGN PATENT DOCUMENTS 38 44 313 C2 5/1990 Germany .

*Primary Examiner*—Tamara L. Graysay

*Assistant Examiner*—Tara L. Mayo

*Attorney, Agent, or Firm*—Herbert Dubno

[57] ABSTRACT

An apparatus for and a method of shoring a trench. The apparatus includes two vertical posts which are adapted to be disposed at the borders of the trench in an opposite relation and a rigid frame which is locatable at and vertically movable along the posts and which is secured within the posts. Laterally, the posts have receptacles for shoring plates adapted to be disposed in the longitudinal direction of the trench. The posts with the shoring plates and the frame can be lowered successively to the corresponding working depth by the reinsertion of bolts at the posts which serve for holding the frame.

19 Claims, 9 Drawing Sheets

FIG. 3
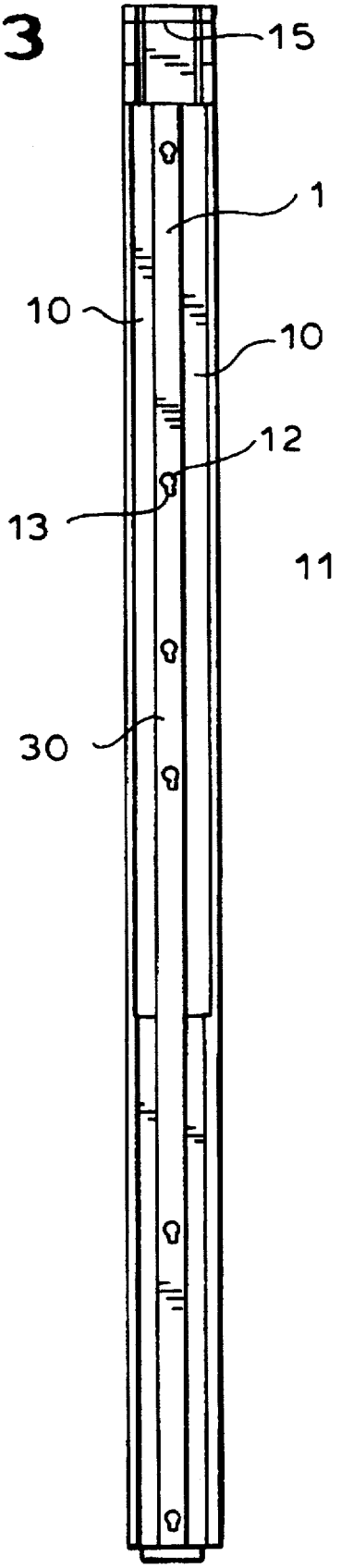
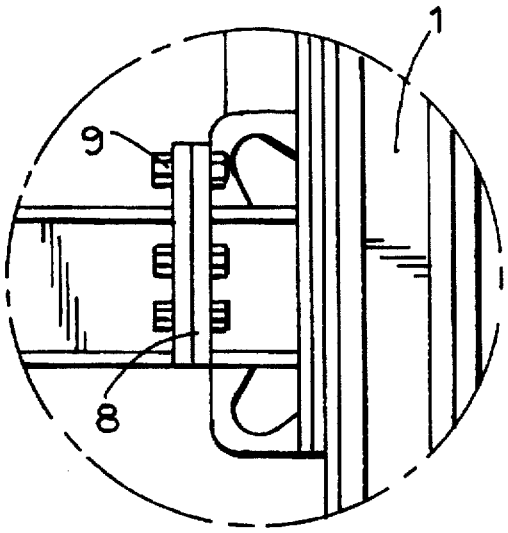
FIG. 2
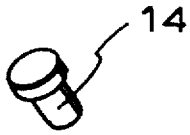
FIG. 1A

APPARATUS FOR AND METHOD OF SHORING A TRENCH

FIELD OF THE INVENTION

The present invention is directed to an apparatus for shoring a trench, said apparatus comprising two vertical posts which are adapted to be disposed at the borders of the trench in opposite relation, and a rigid frame lockable at and movable along the posts and extending transversely across the trench and supporting the posts with respect to one another.

Such an apparatus is known from German patent 38 44 313. In this known apparatus the rigid frame has, adjacent to the posts, a respective vertical side member which is supported in a C-shaped post by means of rollers guided in the post. Guide members are provided on the side of the side member of the frame opposite to the rollers. These guide members prevent tilting of the side member of the frame within the C-shaped hollow post. The hollow post serves for the support of shoring plates extending in longitudinal direction of the trench and preventing collapsing of the trench during excavation. The shoring plates sit close to that front face of the C-shaped hollow post which is directed towards the border of the trench.

The rigid frame is movable up and down within the oppositely arranged posts by means of the rollers which are disposed at the upper and lower end of the vertical side members of the frame. Accordingly, the position of the frame can be adapted to the respective depth of the trench.

However, it has become obvious that problems can occur with such an arrangement of the vertical side members of the frame in hollow posts because stones and other foreign matter can collect within the hollow posts and can make more difficult or totally impossible the rolling movement of the frame. These stones get stuck in the interspaces between the walls of the post and the vertical side members of the frame and block the upward and downward movement of the frame.

Furthermore, in the known embodiment the posts are located in front of the shoring plates towards the middle of the trench and not within the plane of the shoring plates itself. As a result, the insertion and the drawing of the shoring plates is made more difficult.

OBJECTS OF THE INVENTION

It is an object of the invention to provide an apparatus for shoring a trench according to which a perfect rolling or sliding of the frame along the posts and a simultaneous securing of the frame at the posts can be obtained.

Another object of the invention is to provide an apparatus for shoring a trench according to which a perfect rolling or sliding of the frame along the posts and a securing of the same at the posts is obtained, wherein the posts themselves are designed for holding the ends of the shoring plates.

SUMMARY OF THE INVENTION

The above-cited objects are attained with an apparatus for shoring a trench, which comprises said apparatus comprising two vertical posts which are adapted to be disposed at the borders of the trench in an opposite relation, and a rigid frame lockable at and vertically movable along the posts and extending transversely over the trench and supporting the posts with respect to one another.

According to the invention, the posts have lateral receptacles for the end portions of shoring plates which are adapted to be disposed in the longitudinal direction of the trench. Adjacent to the posts the rigid frame can include a respective vertical side member, the side member having centrally at its front face directed to the post a securing portion projecting towards the post and rolling or sliding means on both sides of the securing portion.

The front face of the post directed to the side member of the frame can have centrally a longitudinal slot and on both sides of the longitudinal slot surface, portions in engagement with the rolling or sliding means. The securing portion can extend through the slot into a recess in the post enlarged with respect to the slot, whereby a separation of post and frame in the transverse direction of the trench is prevented.

Accordingly, with the inventive solution the vertical side members of the rigid frame are not guided in hollow posts which have the above-cited disadvantages, but are guided along the outsides of the posts, namely, along the front faces thereof directed towards the middle of the trench. As a result, stones etc. cannot get stuck between the rolling or sliding means and the corresponding surface portions of the posts. In order to prevent a separation between the frame and the post in transverse direction of the trench the frame has a securing portion or securing member which engages into the slot and the recess and prevents removal of the frame from the post towards the middle of the trench if a corresponding tensile load occurs. This securing portion or securing member is preferably formed as T-shaped portion which extends through a slot in the post into a recess in the post which is enlarged with respect to the slot. The securing member does not impede the upward and downward movement of the frame. Since the web of the T-shaped portions is adapted relatively closely to the corresponding slot and since also the flange of the T-shaped portion is adapted relatively closely to the corresponding recess the danger of blocking of these interspaces by stones etc. falling into the post is relatively small.

According to another feature of the invention the post has lateral receptacles for the end portions of shoring plates adapted to be disposed in the longitudinal direction of the trench. At least one receptacle can be provided on each side. With "sides" those limiting surfaces of the post are meant which extend perpendicularly to the axis of the trench.

Preferably, the receptacles for the end portions of the shoring plates are formed in a C-like manner, wherein the associated shoring plates have T-shaped end portions which are guided within the C-profiles of the posts and which are retained in the longitudinal direction of the trench.

It is also possible that more than one receptacle for a shoring plate is provided on each lateral surface of the post. For example, two receptacles can be juxtaposed and can serve for the arrangement of stepwisely disposed shoring plates. According to such an embodiment, for example, the receptacle on the side of the trench serves for the positioning of lower shoring plates while the adjacent receptacle located on the side of the trench border serves for the positioning of shoring plates located higher. Dependent on the depth of the trench even further receptacles can be arranged one besides the other.

As regards the shape of the post, the same is preferably of rectangular cross-section, wherein the two limiting surfaces extending perpendicularly to the axis of the trench are formed by the receptacles for the shoring plates which are preferably C-shaped. As mentioned above, the front face of the post directed to the side member of the frame has centrally a longitudinal slot and on both sides of the longitudinal slot surface portions along which the frame rolls or slides. The opposite front face of the post on the side of the border of the trench is preferably plane.

According to an especially preferred embodiment the post consists of two oppositely arranged C-profiles, a flat profile connecting the same on the side of the trench border and two flat profiles on the side of the trench between which the above-mentioned slot is formed. These members are welded with one another. Corresponding support members for reinforcing the post are still provided in the interior of the post designed in such a manner.

The recess in the post enlarged with respect to the slot is limited by an end wall which connects the two limiting surfaces (receptacles) of the post extending transversely with respect to the axis of the trench. This wall, which is preferably formed by a flat profile, is welded to the receptacles.

In order to be able to lock the rigid frame in desired positions along the post the post is provided with spaced holes along its length. Bolts are insertable into these holes and serve for supporting the lower edge of the vertical side members of the rigid frame. Practically, these holes are provided along the post wall which limits the recess for the reception of the T-shaped portion.

For securing the bolts in a tight manner the same have preferably a laterally projecting lug which is insertable into a complementarily formed enlargement of the corresponding hole. After the insertion of the bolts the same are rotated by 180° so that the lug engages behind the corresponding post wall and a locking of the bolt is achieved. For releasing the bolt the same is again rotated for 180° into a position in which the lug can be withdrawn through the enlargement of the hole.

In the normal case, i.e. with parallel arrangement of frame and post, the T-shaped securing portion or member is disposed and movable in a contact-free manner within the slot and the corresponding enlarged recess. In other words, the T-shaped member does not slide along the associated limiting surfaces of the post but is formed as true securing member which only prevents a removal of the frame from the post upon tensile loads. In a V-position between frame and post the T-flange of the securing member contacts the corresponding limiting surfaces of the recess on the side of the trench and prevents a further movement of the frame towards the middle of the trench.

According to an especially preferred embodiment the vertical side member of the rigid frame is formed as double-T-profile. The one flange and a portion of the web of this double-T-profile forms the T-shaped portion serving as securing member which is diposed within the post.

Accordingly, with this embodiment no special T-shaped portion has to be provided.

According to another preferred embodiment of the invention, according to which a plurality of receptacles for shoring plates are juxtaposed on the limiting surfaces of the post extending perpendicularly with respect to the axis of the trench, these receptacles do not extend over the complete height of the post but only over a part thereof. As already mentioned, the receptacles on the side of the trench serve for the positioning of lower shoring plates and extend only over the lower part of the post, while the outer receptacles serving for the positioning of higher disposed shoring plates extend from the lower end of the post to the upper end of the same or, if a third receptacle is located besides, extend over a longer distance in a stepwise manner etc.

In order to reinforce the posts the flat profiles connecting the receptacles for the shoring plates are preferably reinforced over defined height ranges of the posts by inner profiles which are welded on. These reinforced portions are preferably located in a region which extends over approximately ⅓ of the length of the post and begins at a distance from the lower end of the post which also corresponds to a third of the length of the post.

Preferably, the rigid frame can be square and can consist of two vertical side members and an upper and lower horizontal connecting member. Preferably, the vertical side members are C-shaped, i.e. have horizontal shoulders in their end portions and are preferably adapted to be screwed together with the connecting members by means of flange joints. This solution has the advantage that the frame can be adapted to the respective width of the trench in a relative simple manner by the insertion of connecting members having a different length.

In order to enable a movement of the rigid frame relative to the posts the same has appropriate rolling or sliding means. According to a special embodiment the rigid frame has in each corner two rollers located one above the other which are preferably disposed in roller boxes which serve for the support of a roller shaft. Roller positions are disposed on both sides of the securing member (T-shaped portion). The two adjacent roller positions separated by the securing member are preferably located on a common shaft which is rotatably supported in a central stationary sleeve.

According to another embodiment the rigid frame has in each corner a sliding plate, wherein the sliding plate is preferably divided into two portions which are located on both sides of the securing member.

The rollers and sliding plates can consist of customary known materials which should be characterized by a high resistance to wear.

Furthermore, the invention is directed to a method of shoring a trench with the use of an apparatus of shoring a trench according to one of the preceding claims. This method comprises the following steps:

a. excavating a narrow and flat pre-trench transversely with respect to the shoring direction, the length of the pre-trench substantially corresponding to the width of the trench to be shored;

b. assembling a structure consisting of two posts and a rigid frame connecting the same, wherein the frame is supported on bolts located at the lower ends of the posts and the posts have another bolt in the upper range, respectively, in order to prevent an upward movement of the frame too far;

c. pressing the structure into the pre-trench and coupling the shoring plates disposed on the ground surface to the posts to give the structure stability;

d. excavating the trench;

e. lowering the posts and the shoring plates until the frame abuts the upper bolts;

f. lowering the frame until the same abuts the lower bolts;

g. repeating the steps d–f until the working depth is reached;

h. reinserting the upper bolts into the upper end portion of the posts;

i. lifting the frame until the same abuts the upper bolts; and j. reinserting the lower bolts below the lower end of the frame.

After the lower bolts have been inserted below the lower end of the frame the frame is secured in the upper portion of the trench so that a sufficiently great working height in the lower region of the trench is present and so that, for instance, sewage pipes can be placed. When the emplacement work is finished one can start with the work of retreating. When doing this, soil is backfilled, and the shoring plates and posts are withdrawn. The backfilled soil is compacted, whereafter the shoring plates and the posts are drawn again. Of course, prior to the start of retreating the lower bolts have to be reinserted from their position directly below the frame to a lower position with a corresponding distance with respect thereto so that the frame can roll or slide into a lower position when the posts are drawn. The frame can then remain in this lower position upon further retreatment (drawing of shoring plates and posts), or the bolts can be reinserted again.

If greater trench depths are present, additional shoring plates are used when carrying out the steps d–f. These additional shoring plates are positioned over the shoring plates which are already installed. Preferably, the additional shoring plates are arranged parallel and laterally offset with regard to the installed shoring plates.

BRIEF DESCRIPTION OF THE DRAWING

The above and other objects, features, and advantages will become more readily apparent from the following description, reference being made to the accompanying drawing in which:

FIG. 1A is a detail of the apparatus;

FIG. 2 is an enlarged detail of the region II of FIG. 1;

FIG. 3 is an elevational view of a post of the apparatus for shoring a trench seen from the middle of the trench;

SPECIFIC DESCRIPTION

Figure 1:
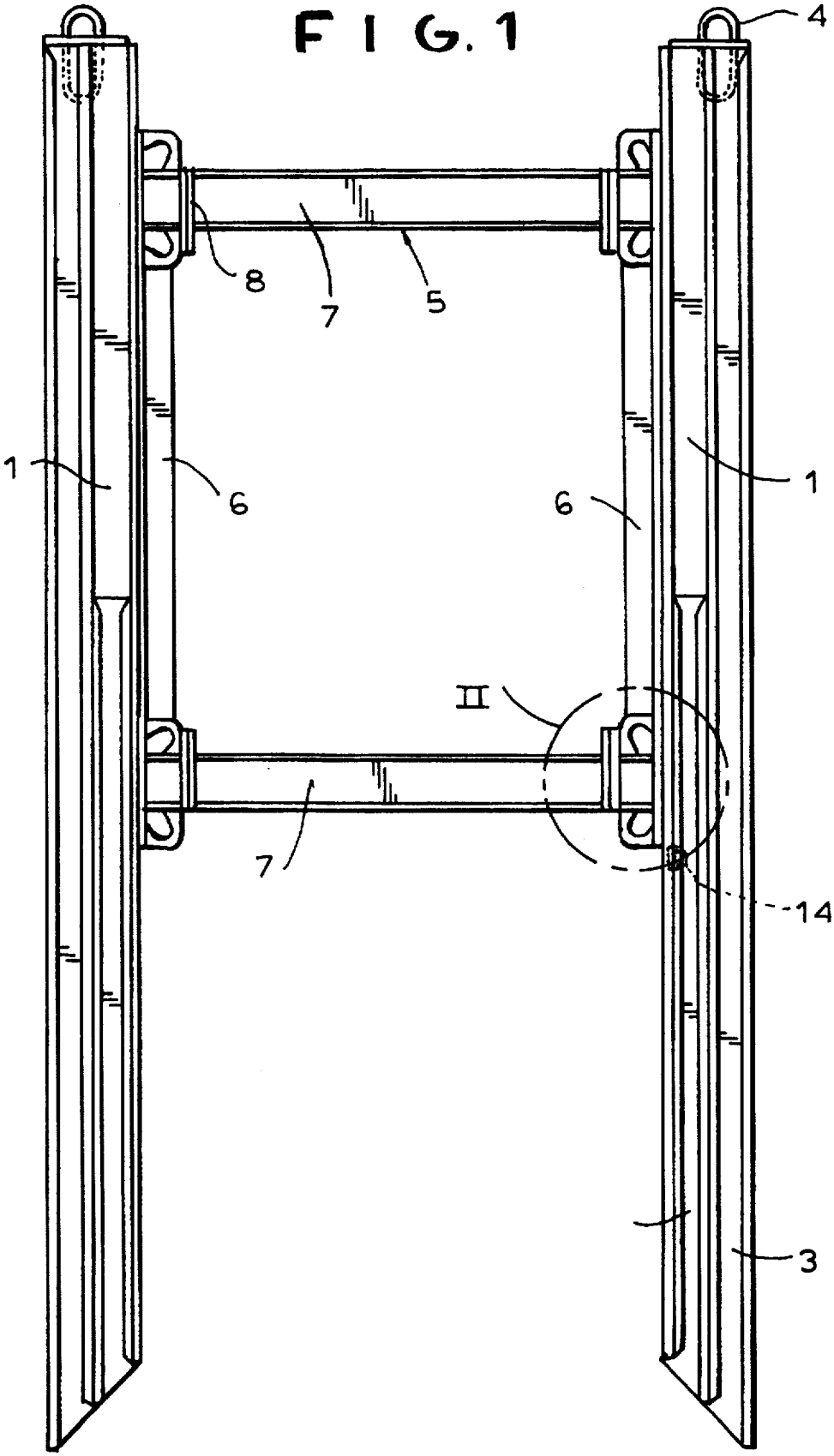
FIG. 1 is a side view of an apparatus for shoring a trench and consisting of a rigid frame and two posts.
Figure 8:
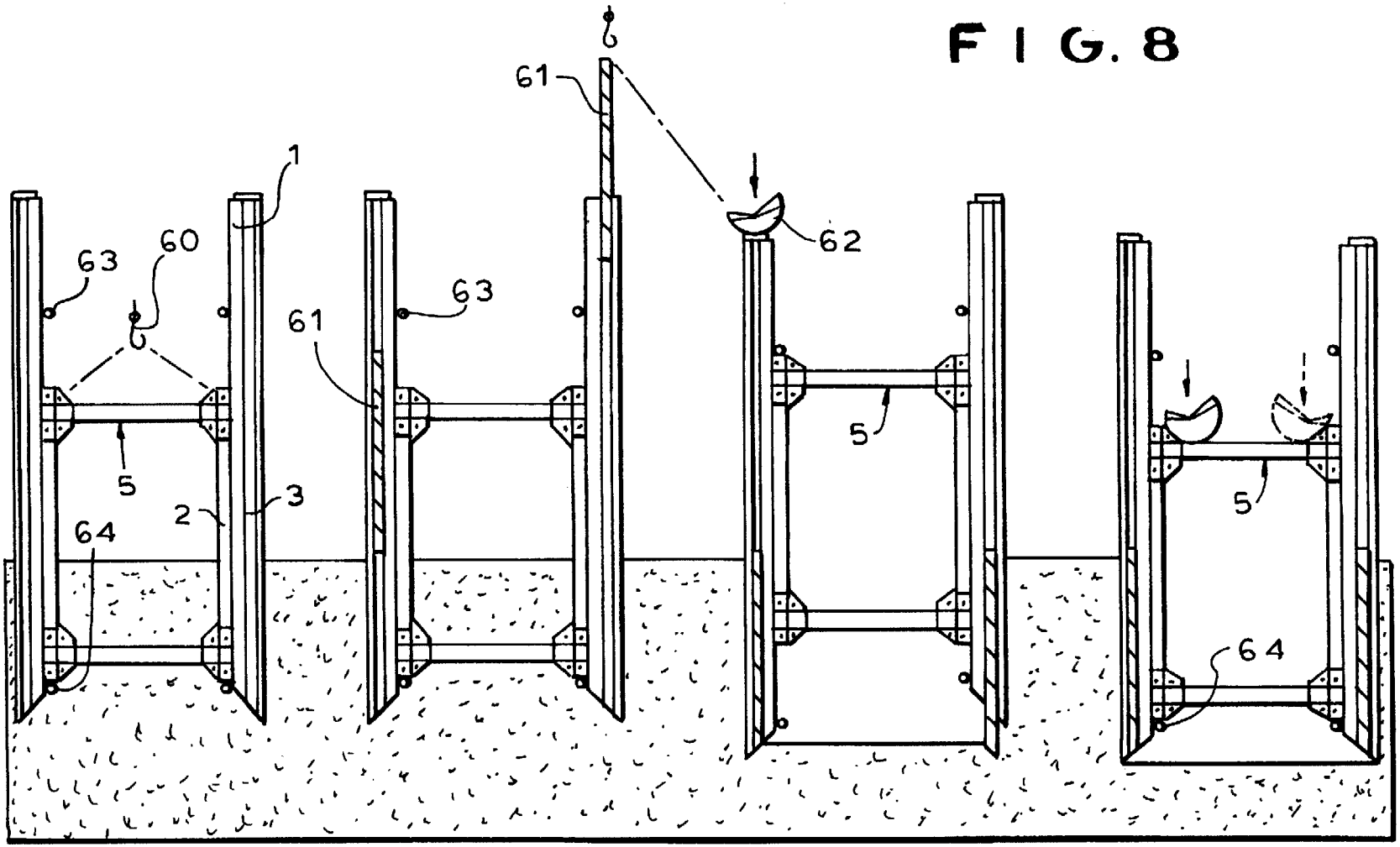
FIGS. 8–10 are diagrams which show the forming and refilling of a trench, wherein the apparatus for shoring the trench is shown in several method stages.
Figure 9:
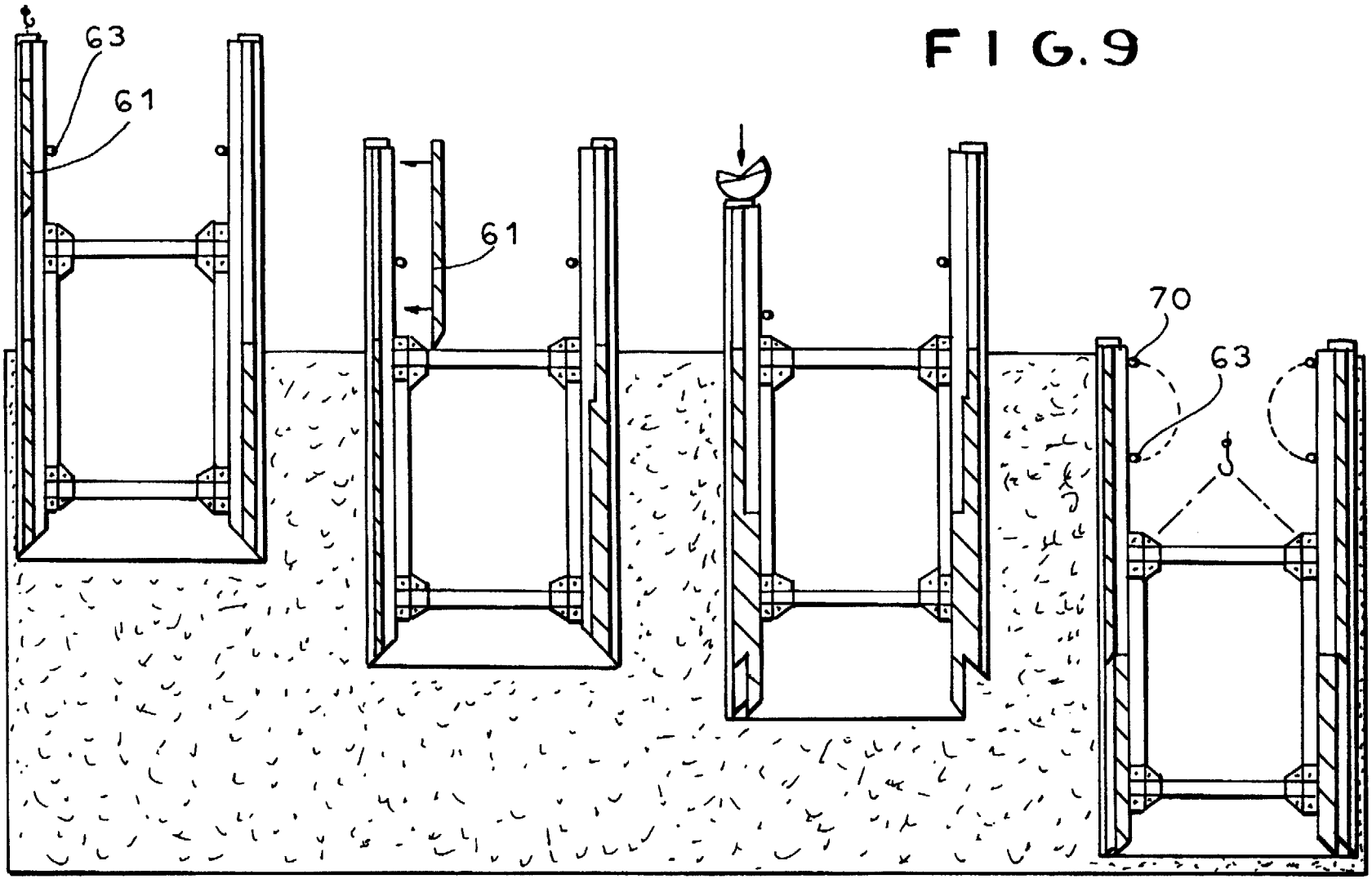
Figure 10:
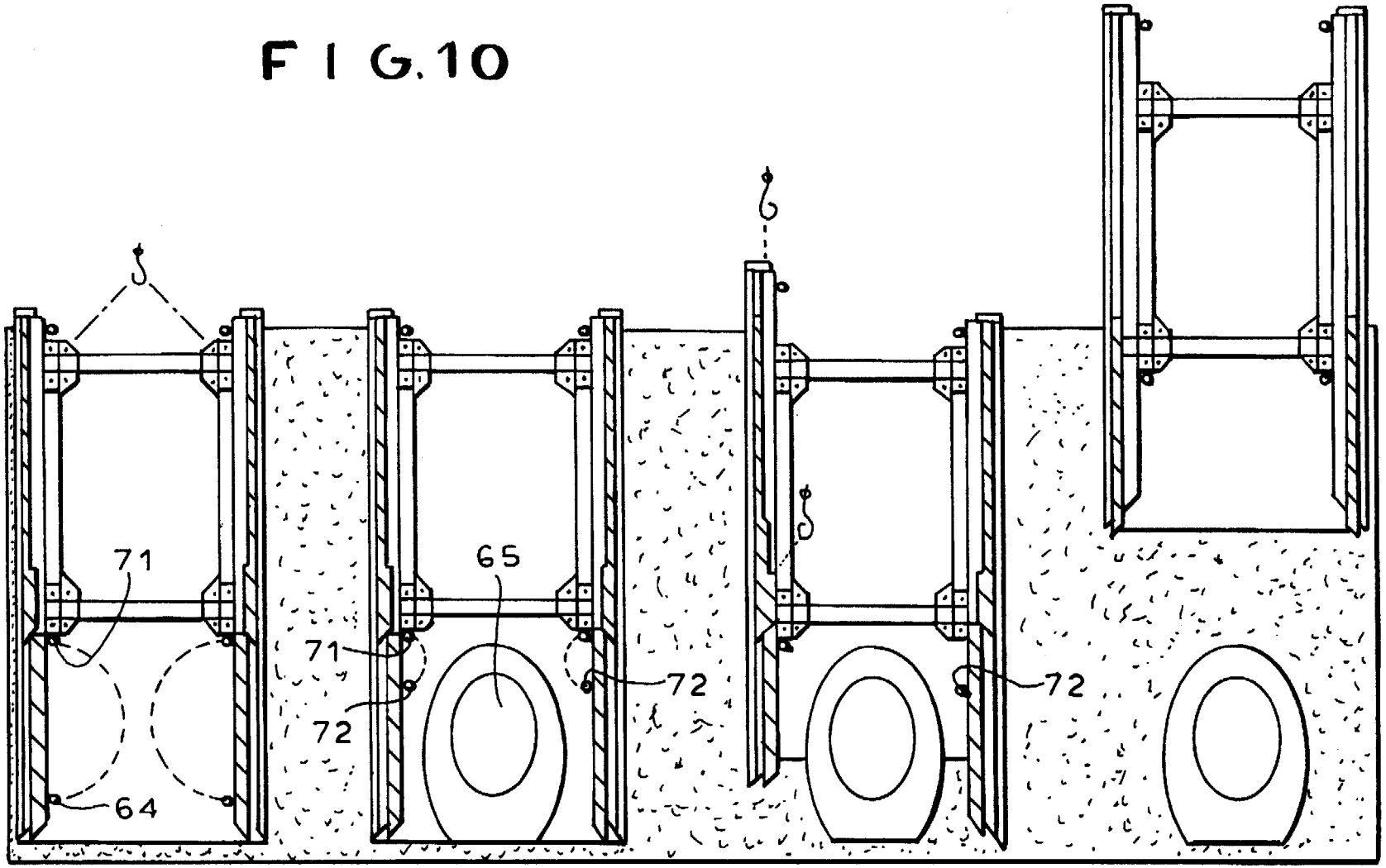

The apparatus for shoring a trench shown in FIG. 1 has two vertical posts 1 which are adapted to be disposed at the borders of a trench in an opposite relation, as shown in FIGS. 8 to 10, and a rigid frame 5 lockable at the posts 1 and vertically movable therealong. The frame extends across the trench and supports the posts with respect to one another. It has respective vertical side members 6 adjacent to the posts 1 as well as two horizontal members 7 which are screwed together (at 9) with the side members 6 by means of flange joints 8. Accordingly, in FIG. 1 the frame forms a rectangle. Of course, the screwing connections are formed in such a manner that a rigid assembly results. Corresponding screwing connections are known.

Furthermore, FIG. 1 shows that the posts 1 have laterally arranged receptacles 2, 3 for shoring plates to be disposed in longitudinal direction of the trench. The shoring plates support the walls of the trench. These receptacles 2, 3 are C-shaped in horizontal section, as for instance shown in the horizontal section of FIG. 6, and serve for the reception of T-shaped heads of the shoring plates. The receptacles 2, 3 form not only a guidance but also a holding device for the shoring plates. As shown in FIG. 1, the receptacle 2 does not extend from the lower cutting edge of the posts over the complete height thereof, while the receptacle 3 runs through from the lower end to the upper end. Since the shoring plates received by the receptacle 2 are positioned only in the lower portion of the posts the receptacles have not to extend to the upper end. The shoring plates of the receptacle 3 are positioned in the upper portion, i.e. stepwisely offset with regard to the shoring plates of the receptacle 2.

FIG. 3 shows a view of a post of the apparatus for shoring a trench of FIG. 1 seen from the middle of the trench. One recognizes that the post 1 has two flat profiles 10 which are in contact with corresponding rolling or sliding means of the rigid frame. A slot 11 is located between the two flat profiles 10, and a corresponding securing member of the frame 5 engages into the slot. The slot 11 enlarges to a recess which is limited by a backwall 30. Holes 12 are spaced in this backwall. Bolts 14 (shown in FIG. 4) are insertible into these holes. The frame 5 is supported on these bolts. Furthermore, the bolts serve as upper stop for the frame. As shown in FIG. 3, the holes 12 have a narrow depression 13 through which a lug 33 disposed at the end of the bolt can be introduced. After the insertion of the bolt the same is rotated for 180° in order to lock the bolt within the hole. At the upper end the post 1 is provided with a suitable cover plate 15.

Figures 4, 4A:
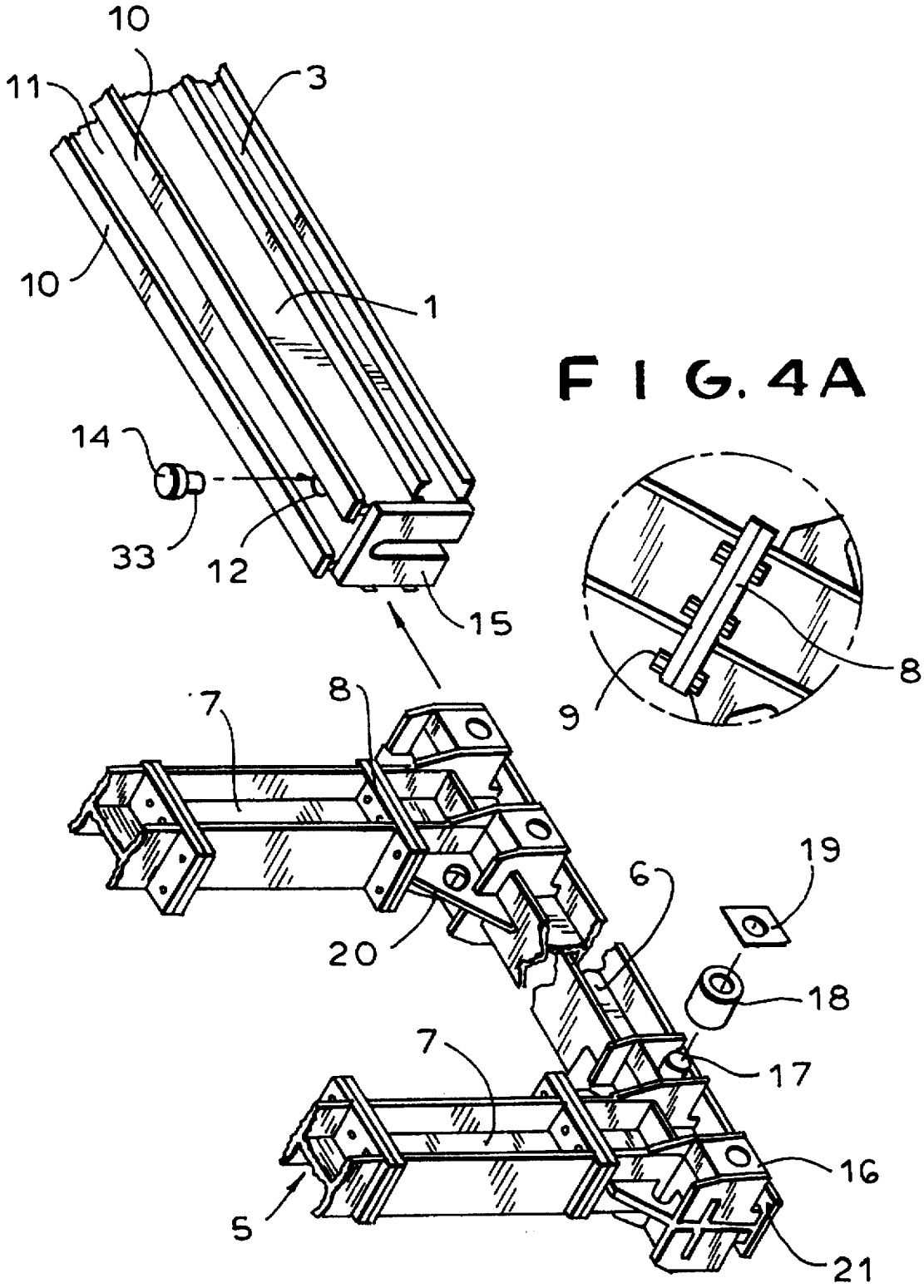
FIG. 4 is a perspective exploded view of a part of the frame as well as a part of the associated post.
FIG. 4A is a detail view of FIG. 4 drawn to an enlarged scale.

FIG. 4 shows details of the post 1 and of the frame 5. One recognizes at the post 1 the lateral receptacle 3 as well as the two flat profiles 10 which are directed to the middle of the trench. The slot located between the flat profiles 10 with the recess located therebehind serves for the reception of a T-shaped securing member 21 of the frame. Further details thereof are described in connection with FIG. 6.

The vertical side member 6 of the frame is double-T-shaped. Also the horizontal connecting members 7 are double-T-shaped. They are connected with horizontal shoulders of the vertical side members 6 by means of a flange joint 8. In this figure several horizontal members 7 are shown which are connected with one another by means of flange joints. The corner connection between the horizontal members and the vertical members is reinforced by means of suitable gusset plates 20.

According to this embodiment the frame is movable along the post by means of rolling means. The rolling means are formed by four roller members 18 of which two are positioned in an end portion of the vertical side member 6, respectively. The roller members have a shaft 17 supported in a stationary sleeve 26 (see FIG. 6). The shaft is provided with corresponding rollers at its both ends. Furthermore, the shaft is disposed in roller boxes 16 which are closed by means of end plates 19. The rollers are in contact with the two sides of the two flat profiles 10 of the posts directed to the middle of the trench and roll along the same.

Figure 6:
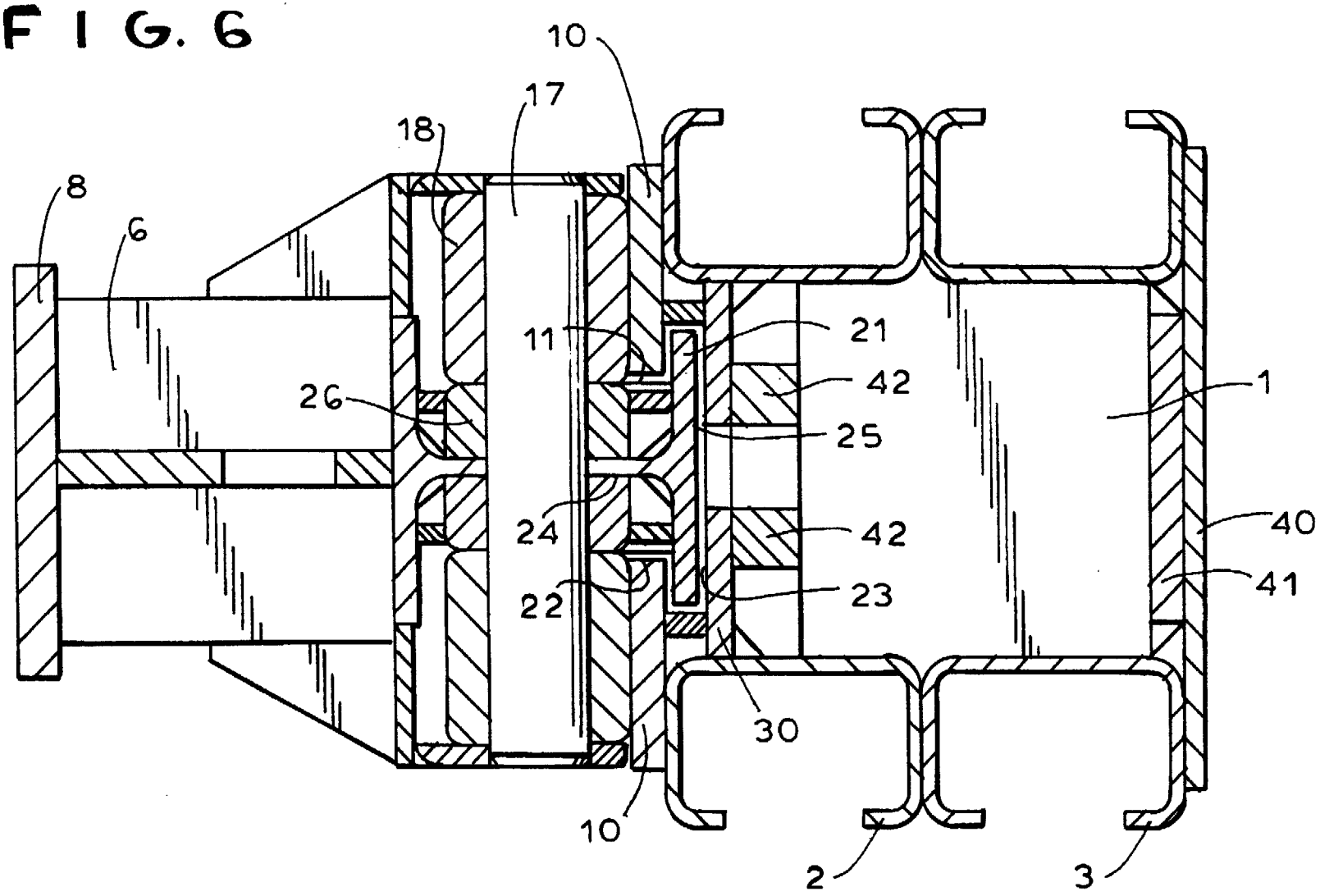
FIG. 6 is a horizontal section of a post and of a portion of a frame in the region of the lower horizontal frame member.

The exact construction of the connection between the frame and the post of this embodiment is shown in FIG. 6. One flange of the double-T-shaped side member 6 together with a portion of the web forms the T-like securing member 21. This securing member extends through the slot 11 of the post inwardly of the edges 22 of the flat profiles 10 into the recess 23 within the post which is enlarged with respect to the slot. The flange 25 of the T-like portion is disposed in this recess while the web portion 24, which is laterally reinforced, is located within the slot. In the normal position shown in FIG. 6, i.e. the parallel arrangement between frame and post, the T-like member 21 does not contact the edges of the slot and of the recess. Only in a V-position can the flange 25 contacts the limiting surfaces of the recess which prevent a removal of the frame from the post in this case.

The post has four receptacles 2, 3 which are formed by C-profiles, respectively. These receptacles are connected through a flat profile 40 reinforced by another flat profiles 41 and the two flat profiles 10. The flat profiles 10 are connected to the backwall 30 through intermediate members which backwall also connects the receptacles. The backwall 30 is reinforced at its backside by means of corresponding slats 42.

The sectional view extends through a roller member in the vertical member 6 of the frame. The roller member has a shaft 17 which is centrally supported in a stationary sleeve 26. The rollers 18 are located on both sides of the sleeve and roll on the front face of flat profiles 10 of the post, as mentioned above.

Figures 5, 5A:
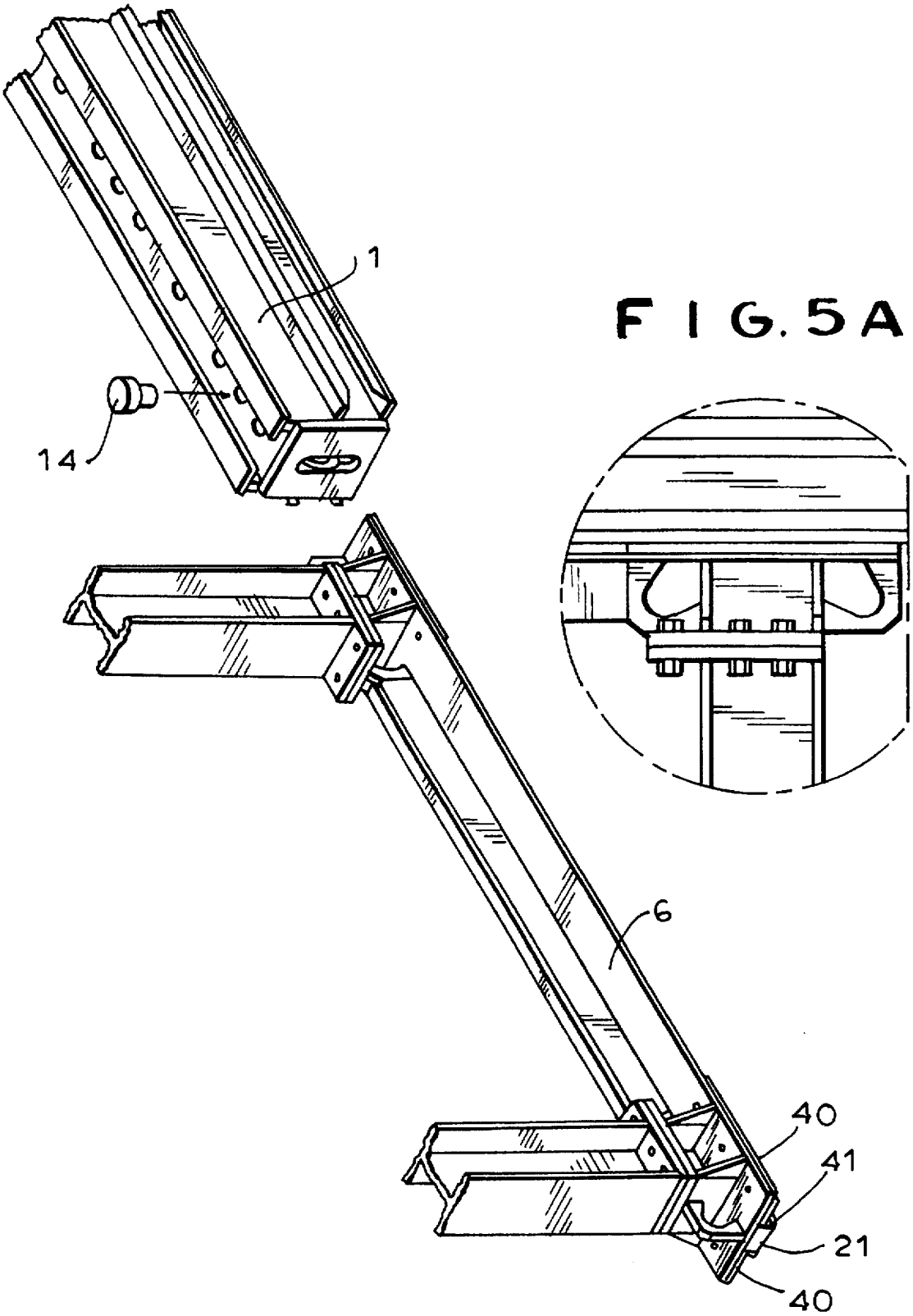
FIG. 5 is a view similar to FIG. 4 wherein the frame is provided with sliding means instead of rolling means.
FIG. 5A is a detail of FIG. 5.
Figure 7:
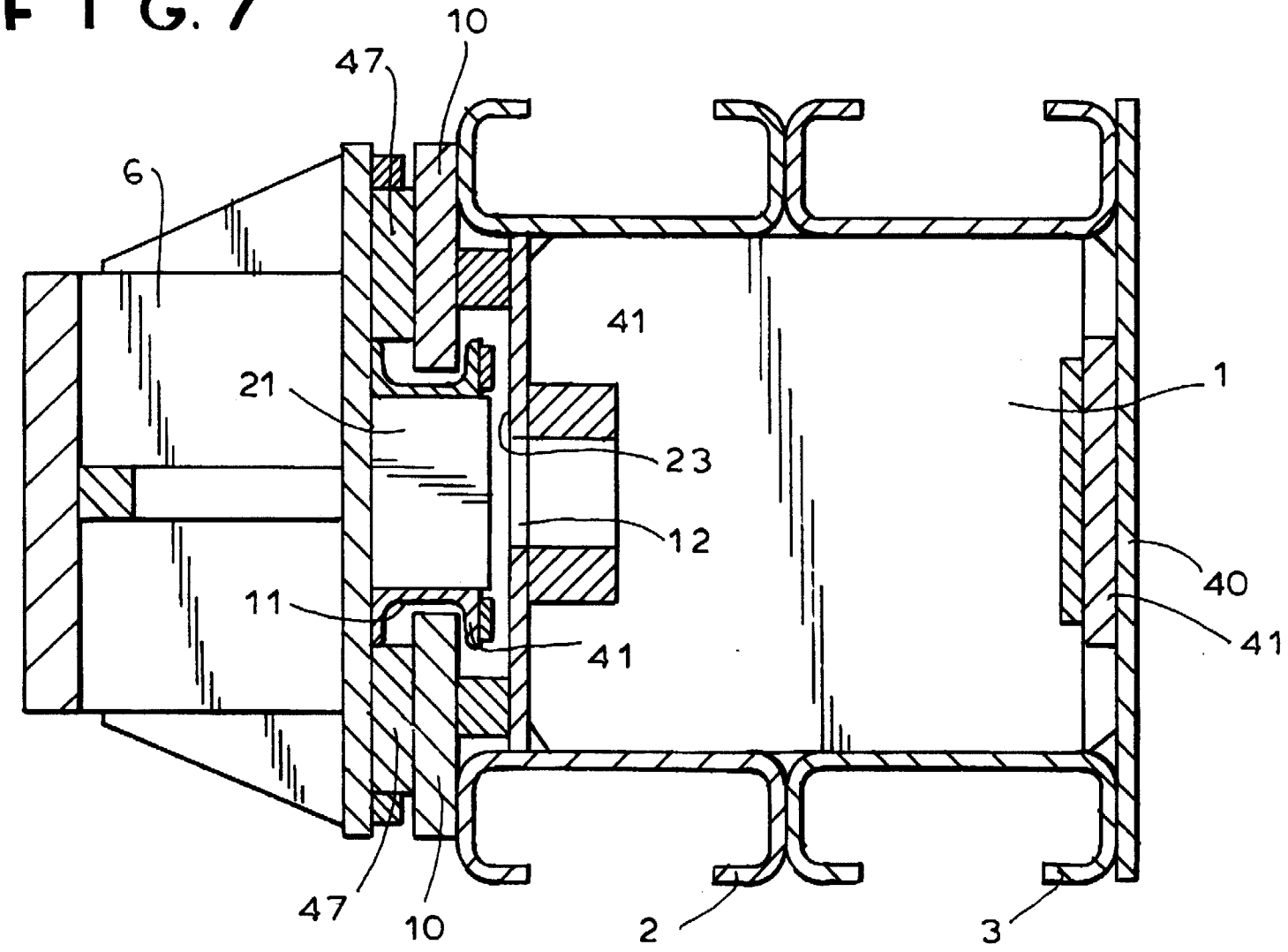
FIG. 7 is a sectional view corresponding to FIG. 6 of the embodiment according to which the frame has sliding means.

FIGS. 5 and 7 show an embodiment according to which the rigid frame 5 does not have rolling means but sliding means. The sliding means consist of two sliding plates 47 which are located at the respective end portions of the vertical side members of the frame in parallel relation. The T-shaped securing member 21 is located between the two sliding plates 47. According to this embodiment the securing member 21 is formed by two C-profiles 41 disposed in opposite relation and extending through the slot 11 into the recess 23 of the poet. Apart from this, the post and the frame have nearly the same construction as the embodiment of FIGS. 4 and 6 so that a further description is not necessary. It has to be still mentioned that the vertical side member 6 of the frame has no double-T-shape but only a T-shape in this embodiment.

FIGS. 8–10 show the flow of the inventive method, wherein an apparatus for shoring a trench consisting of two posts in opposite relation and a rigid frame 5 connecting the same is shown. Each post 1 has two juxtaposed receptacles 2, 3 for shoring plates 61.

In order to realize the trench, at first a narrow and flat pre-trench is excavated transversely with respect to the direction of shoring. The length of the pre-trench substantially corresponds to the width of the trench to be shored. Thereafter, a structure consisting of two posts 1 and a frame 5 connecting the same is assembled. The frame 5 is supported on bolts 64 located at the lower ends of the posts. Each post has another bolt 63 in the upper region in order to prevent an upward movement of the frame 5 too far. Then the structure is pressed into the pre-trench. This condition is shown in the left representation of FIG. 8. The shoring plates 61 are fitted into the outer receptacles 3. This is realized by means of a rope fastened in the drawing eyelet of the plates and fixed at the hook 60 of an appropriate lifting device. The installed outer shoring plates are disposed on the ground surface to give the structure stability. This condition is shown in the second representation from the left in FIG. 8. Thereafter, the excavation of the trench is started. The posts 1 and the shoring plates 61 are lowered until the frame 5 abuts the upper bolts 63. The lowering is realized by means of the shovel of an excavator which is shown at 62. This condition is shown in the second representation from the right of FIG. 8.

Thereafter, frame 5 is lowered by means of the shovel of the excavator until the frame abuts the lower bolts 64. This condition is shown in the right representation of FIG. 8.

Now, the steps of excavating the trench, of lowering the posts and shoring plates and of lowering the frame are repeated until the corresponding working depth is reached.

For this, additional shoring plates 61, so-called increasing plates, are passed into the outer receptacle 3 and are connected to the lower plates. Furthermore, additional shoring plates are passed into the inner receptacles 2. These steps are shown in the three left representations on the left of FIG. 9.

When the working position is reached, the upper bolts 63 are reinserted into the uppermost position shown at 70. This condition is shown in the right representation of FIG. 9. Then, the frame 5 is drawn into the uppermost position until it abuts the bolts shown at 70. Thereafter, the bolts 64 are reinserted from the lowermost position into the position 71 in which they support the frame. In this position the necessary working within the trench can be carried out which is not impeded by the frame in its uppermost position. The corresponding position is shown at the left representation of FIG. 10. The second from the left in FIG. 10 shows the trench after the installation of a sewage pipe 65. In order to refill the trench thereafter, the bolts are reinserted from the position 71 into a lower position 72. Thereafter, soil is refilled and the lower shoring plates 61 as well as the posts 1 are drawn. This condition is shown by the second representation from the right in FIG. 10. The refilled soil is compacted. Through the drawing of the posts, now the frame abuts the bolts positioned at 72. The further retreatment is carried out in accordance with the step described at last, as shown in the right representation of FIG. 10, the hoist engaging an eye 4 at the top of the post (seed also FIG. 1).

Of course, in the longitudinal direction of the trench additional posts, frames and shoring plates can be positioned. Accordingly, the invention is not restricted to two posts and one frame positioned therebetween.

I claim:

1. An apparatus for shoring a trench comprising:

two vertical posts which are adapted to be disposed at borders of a trench in an opposite relation, and a rigid frame lockable at and vertically movable along the posts, said frame extending transversely across the trench and supporting the posts with respect to one another, said posts having lateral receptacles for receiving end portions of shoring plates which are adapted to be disposed in a longitudinal direction of the trench;

said rigid frame including a respective vertical side member adjacent each of said posts, each of said side members having centrally at a respective front face directed toward the respective post a securing portion projecting towards the respective post, and rollers riding on external surfaces of the respective post on both sides of the respective securing portion;

the front face of each post directed toward the respective side member of the frame having centrally a longitudinal slot flanked by said surfaces; and said portion of each side member extending through the respective slot into a recess in the post enlarged with respect to the slot, whereby a separation of the post and the frame in the transverse direction of the trench is prevented, each slot and recess receiving the respective securing portion in a contact-free manner in a parallel arrangement of said frame and said posts.

2. The apparatus according to claim 1, wherein the securing portion is T-shaped.

3. The apparatus according to claim 1, wherein the vertical side member of the rigid frame is double-T-shaped.

4. The apparatus according to claim 1, wherein the securing portion is formed by two C-profiles disposed in opposite relation at the front face of the vertical side member of the frame.

5. The apparatus according to claim 1, wherein the post has on each side a plurality of juxtaposed receptacles for receiving the end portions of the shoring plates.

6. The apparatus according to claim 5, wherein the juxtaposed receptacles extend from the lower end of the post through different heights.

7. The apparatus according to claim 1, wherein the receptacles have a narrowed inlet portion.

8. The apparatus according to claim 1, wherein the rigid frame is lockable by bolts supporting the frame and insertable into holes of the posts.

9. The apparatus according to claim 1, wherein the post is approximately rectangular in cross-section and comprising the receptacles, flat profiles connecting the receptacles and two narrow flat profiles defining the recess and disposed at the receptacles.

10. The apparatus according to claim 9, wherein the flat profiles connecting the receptacles are reinforced through defined height region of the post by inner profiles welded thereon.

11. The apparatus according to claim 1, wherein the rigid frame consists of two vertical side members and an upper and a lower horizontal connecting member.

12. The apparatus according to claim 11, wherein the side members are adapted to be screwed together with connecting members of various lengths.

13. The apparatus according to claim 11, wherein the side members are C-shaped and are adapted to be screwed together with the connecting members by means of flange joints.

14. The apparatus according to claim 1, wherein the rigid frame has two rollers located one above the other.

15. The apparatus according to claim 14, wherein the rollers are located in roller boxes which serve for a roller shaft.

16. A method of shoring a trench comprising the steps of:

excavating a narrow and flat pre-trench transversely with respect to a shoring direction, the length of the pre-trench substantially corresponding to a width of the trench to be shored;

assembling a structure consisting of two posts and a rigid frame connecting the same, wherein the frame is supported on bolts located at lower ends of the posts and the posts have another bolt in an upper region, respectively, in order to prevent an excessive upward movement of the frame;

pressing the structure into the pre-trench and coupling shoring plates to the posts to stabilize the structure;

excavating the trench;

lowering the posts and the shoring plates until the frame abuts the upper bolts;

lowering the frame until the frame abuts the lower bolts;

repeating the steps until a working depth is reached;

reinserting the upper bolts into upper end portions of the posts;

lifting the frame until the frame abuts the upper bolts; and reinserting the lower bolts below the lower end of the frame.

17. The method according to claim 16, wherein additional shoring plates are used when carrying out the steps d–f.

18. The method according to claim 16, wherein the additional shoring plates are disposed above the shoring plates which have previously been installed.

19. The method according to claim 16, wherein the additional shoring plates are disposed in parallel relation and laterally offset with respect to the previously installed shoring plates.

* * * * *